US010662646B2

(12) United States Patent
Lee

(10) Patent No.: US 10,662,646 B2
(45) Date of Patent: May 26, 2020

(54) PREFABRICATED WALL FOR INTERIOR AND CONSTRUCTION METHOD THEREFOR

(71) Applicant: Chung Jong Lee, Seoul (KR)

(72) Inventor: Chung Jong Lee, Seoul (KR)

( * ) Notice: Subject to any disclaimer, the term of this patent is extended or adjusted under 35 U.S.C. 154(b) by 0 days.

(21) Appl. No.: 16/304,084

(22) PCT Filed: Mar. 24, 2017

(86) PCT No.: PCT/KR2017/003220
§ 371 (c)(1),
(2) Date: Nov. 21, 2018

(87) PCT Pub. No.: WO2017/204453
PCT Pub. Date: Nov. 30, 2017

(65) Prior Publication Data

US 2020/0032507 A1 Jan. 30, 2020

(30) Foreign Application Priority Data

May 26, 2016 (KR) ..... 10-2016-0064635

(51) Int. Cl.
*E04B 2/74* (2006.01)
*E04B 9/26* (2006.01)

(52) U.S. Cl.
CPC ..... *E04B 2/7453* (2013.01); *E04B 9/26* (2013.01); *E04B 2002/7462* (2013.01)

(58) Field of Classification Search
CPC .... E04B 2/7453; E04B 2/7457; E04B 2/7407; E04B 2/789; E04B 2/78; E04B 2002/7462
See application file for complete search history.

(56) References Cited

U.S. PATENT DOCUMENTS 5,546,718 A * 8/1996 Way ..... E04B 2/7409 160/135
2001/0025463 A1 10/2001 Rudduck
(Continued)

FOREIGN PATENT DOCUMENTS

CN 1233306 A 10/1999
CN 2522489 Y 11/2002
(Continued)

*Primary Examiner* — Christine T Cajilig
(74) *Attorney, Agent, or Firm* — Novick, Kim & Lee, PLLC; Jae Youn Kim

(57) ABSTRACT

Provided is a prefabricated wall for interior, which partitions the indoor space of a building, the prefabricated wall comprising: a runner installed to face a ceiling and a floor; a plurality of studs vertically installed and fixed on both width-wise sides of the runner; and a finishing panel coupled to the plurality of studs, wherein each of the plurality of studs includes a pair of coupling grooves extending in parallel to each other in the lengthwise direction, the finishing panel includes a pair of elastic coupling members which are fixedly coupled to both ends of left and right sides of the inner side surface thereof so as to extend in a vertical direction, and the finishing panel is installed on front surface portions of the plurality of studs by inserting and coupling the elastic coupling members into the coupling grooves. Therefore, the present invention minimizes the use of screws to facilitate the installation/disassembly and reassembly of a wall, allows a small number of personnel to simultaneously perform the installation or disassembly work, reduces labor costs, and can shorten the construction period.

9 Claims, 12 Drawing Sheets

(56) References Cited

U.S. PATENT DOCUMENTS

| | | | | |
|---|---|---|---|---|
| 2004/0168382 | A1* | 9/2004 | Rudduck | A47B 91/02 52/238.1 |
| 2012/0167523 | A1* | 7/2012 | Krieger | E04B 2/7453 52/775 |

FOREIGN PATENT DOCUMENTS

| | | | | |
|---|---|---|---|---|
| CN | 203873334 | U | 10/2014 | |
| DE | 2606645 | A1 * | 9/1976 | E04B 2/78 |
| JP | 2008-111336 | A | 5/2008 | |
| JP | 2010090604 | A | 4/2010 | |
| JP | 2014-185462 | A | 10/2014 | |
| KR | 20-1999-0028005 | U | 7/1999 | |
| KR | 10-2000-0049102 | A | 7/2000 | |
| KR | 20-2000-0017366 | U | 9/2000 | |
| KR | 10-0695700 | B1 | 3/2007 | |
| KR | 10-0838961 | B1 | 6/2008 | |
| KR | 10-2010-0091054 | A | 8/2010 | |
| KR | 10-2010-0107702 | A | 10/2010 | |
| KR | 10-1529009 | B1 | 6/2015 | |
| WO | WO-0248474 | A1 * | 6/2002 | E04B 2/78 |

* cited by examiner

PREFABRICATED WALL FOR INTERIOR AND CONSTRUCTION METHOD THEREFOR

TECHNICAL FIELD

The present invention relates to a prefabricated wall for interior and its construction method, more particularly to a prefabricated wall for interior and its construction method in which a plurality of studs are vertically installed and fixed between runners installed to face a ceiling and a floor, and an elastic coupling member provided on an inner side surface of a finishing panel is inserted and coupled into a coupling groove provided on a stud, thereby minimizes use of screws to facilitate an installation/disassembly and reassembly of a wall and also allows a small number of personnel to perform the installation or disassembly work at once, and reduces labor costs, and can shorten a construction period.

BACKGROUND ART

Generally, partitioning an indoor space of many kinds of buildings is made with a fixable wall or a prefabricated wall. Recently such prefabricated wall has been more constructed by manufacturing and assembling a plurality of boards instead of numerous processes. However, the existing prefabricated wall is focusing on assembling of materials other than disassembling, therefore moving and installing and recycling of already constructed wall is difficult.

Such existing prefabricated wall is constructed with numerous members such as a stud, a runner, a molding, a fixing member, a finishing member etc. and requires many construction works. Moreover, modification to comply with conditions of a construction site is not possible, and an electric wiring or a cooling equipment requires even a customary manufacturing. In addition, construction procedure is complicated and takes long period of time thus it was problematic that maintenance and repair of the prefabricated wall is not easy.

As one example of such prefabricated wall related technologies, a patent document no. 1 as below proposed "the fabricated lightweight wall panel and its connection structure", and a patent document no. 2 as below proposed "Removable Dry Wall Panel", as well as a patent document no. 3 belonging to the present applicant proposed "Assembling Structure and Construction Method for Removable Wall Frame System".

(patent document no. 1) Korean registered patent publication no. 10-0695700 (published on Mar. 15, 2007)

(patent document no. 2) Korean registered patent publication no. 10-0838961 (published on Jun. 16, 2008)

(patent document no. 3) Korean registered patent publication no. 10-1529009 (published on Jun. 15, 2015)

DISCLOSURE

Technical Problem

The patent document no. 1 proposed the fabricated lightweight wall panel and its connection structure having increased sound-proof and heat insulation capacities and maintaining sound-proof and fire-proof capacities even with studs that enable connection between panels, and providing simple connection structure to each other to then make construction easier as well as brings connection's strength. However, it was simply to continuously connect each other by mounting a concave-convex portion at both ends together with its complicated panel structures, but cannot use for constructions of the whole glass or the other whole wall etc.

The patent document no. 2 proposed a removable dry wall panel in which a fixing pole is screw-connected to a ceiling and a floor, and then a modularized wall is slidably connected to the fixing pole, thereby in order to minimize damages in the ceiling and the floor as well as to allow easier and faster assembly and disassembly of the wall to then improve maintenance and repair capacities of a dry wall. However, it was a problem that a fixing stud forming the wall includes complicated structure and assembly of elastic structure such as a spring and other supporting plate makes construction processes complicated and raises costs by additional manufacturing of accessory materials.

The patent document no. 3 proposed a frame assembly and its construction method in which enables assembly and disassembly of an inner wall by an inserting projection and a projection insertion groove provided to a side surface or an end of each constituent frame in the form of concave-convex without other connection component such as a screw with a help of installation of a removable wall frame assembly, and an edge of assembled frame is connected to a molding that increases connection capacity between assembled frames as well as hides tracks left by construction and acts as means of ornaments at the same time. However, it was a problem that it has numerous frames and complicated assembly processes.

An objective of the present invention is to solve such problems, and is to provide a prefabricated wall for interior and its construction method in which a plurality of studs are vertically installed and fixed between runners that are installed to face a ceiling and a floor, an elastic coupling member provided at an inner surface of a finishing panel is inserted into and combined with a coupling groove provided at the stud, thereby in order to minimize the uses of screws to then facilitate installation, disassembly and re-assembly of a wall, which results to allow a small number of personnel to simultaneously perform the installation or disassembly work, reduce labor costs, and shorten the construction period.

Technical Solution

In order to achieve the above objects, the present invention provides a prefabricated wall for interior which partitions an indoor space of a building, which is also a prefabricated wall partitioning an indoor space of a building, the prefabricated wall comprises a runner installed to face a ceiling and a floor; a plurality of studs vertically installed and fixed on both width-wise sides of the runner; and a finishing panel coupled to the plurality of studs, wherein each of the plurality of studs are provided with a pair of coupling grooves that is configured to extend in parallel to each other in a lengthwise direction, the finishing panel is provided with a pair of elastic coupling members which are fixedly coupled to both ends of left and right sides of an inner side surface of the finishing panel so as to extend in a vertical direction, and each of the pair of coupling grooves is provided on its left and right inner side surfaces with one or more stopping protrusion extending in a lengthwise direction, wherein each of the pair of elastic coupling members comprises a contact portion that adheres to the inner side surface of the finishing panel, and a protruding portion that is configured to protrude from the contact portion in an inward direction and extend in a lengthwise direction, wherein the protruding portion is provided on its central portion with a separation groove that forms concavely in a lengthwise direction such that a left side coupling piece and a right side coupling piece are formed on left and right sides of the separation groove, wherein one or more coupling projection is formed to extend in a lengthwise direction on a left side surface of a left coupling piece and a right side surface of a right coupling piece so as to be stuck with the one or more stopping protrusion, wherein each of the pair of elastic coupling members further comprises a panel side finishing wing portion that is bent from one end of the contact portion so as to encompass a side surface portion of the finishing panel and is configured to extend in a lengthwise direction, wherein the finishing panel is installed on a front surface portion of the plurality of studs by inserting and coupling the protruding portion of the elastic coupling members into the coupling grooves.

Further, the prefabricated wall may further comprise an elastic piece that is configured to extend in a lengthwise direction with a "U" shaped section in order to prevent a reduction in a restoring force of the left side coupling piece and the right side coupling piece by inserting into the separation groove, wherein the elastic piece is coupled, so as to extend in a vertical direction to both ends of left and right sides of the inner side surface of the finishing panel, with the pair of elastic coupling members in a state that the elastic piece is being inserted into the separation groove, thereby each of the pair of elastic coupling members is fixed to the finishing panel.

Further, the prefabricated wall may further comprise a gapper that is configured to be compressed and installed between the finishing panels in order to block and finish between the finishing panels adjacent to each other, wherein the gapper comprises a pair of panel side compressing pieces and a center connecting portion.

Further, the prefabricated wall may further comprise a washboard occluding an area from a ceiling or a floor to a position that the finishing panel is installed, and a molding member covering between one end of the washboard and the ceiling or the floor, wherein the runner comprises a base portion that adheres to the ceiling or the floor, a mounting frame portion that is configured to protrude at a center part of one side of the base portion to extend in a lengthwise direction, and a washboard coupling groove that is configured to extend in a lengthwise direction at both ends in a widthwise direction of the base portion, wherein the washboard further comprises a runner coupling piece that is configured to be bent inward from an end of a direction adjacent to the ceiling or the floor to extend in a lengthwise direction, and a molding coupling groove that is configured to be bent inward at end of a direction adjacent to the ceiling or the floor to extend in a lengthwise direction, wherein the molding member comprises a washboard coupling portion that is configured to extend in a lengthwise direction so as to be inserted into and coupled with the molding coupling groove, a corner finishing portion that is configured to be inclined such that one side of a widthwise direction thereof contacts with one end of the washboard and the other side thereof contacts the ceiling or the floor, wherein a rear surface of a lengthwise direction end of the plurality of studs is adhered to both side surfaces of a widthwise direction of the mounting frame portion to be combined and fixed thereto, respectively, wherein the washboard is installed in both sides of a widthwise direction of the runner by the runner coupling piece being inserted into and combined with the washboard coupling groove, wherein the molding member is installed at the washboard by the washboard coupling portion being inserted into and combined with the molding coupling groove.

Further, the prefabricated wall may further comprise a column assembly to allow a wall consisting of the finishing panel combined with the plurality of studs to be adjacent to each other so as to form a corner, wherein the column assembly comprises a first column member that is combined to one side of the finishing panel at an inner side of the corner consisted of the wall, an edge column member to form an outer edge of the corner consisted of the wall, and a second column member that is provided with a second coupling groove which is configured to extend in a lengthwise direction for the elastic coupling member fixedly combined to the finishing panel to be inserted and combined in one side of a widthwise direction, and that is combined to one side of a widthwise direction of the edge column member in the other side, wherein the first column member comprises a first stopping protrusion that is configured to extend in a lengthwise direction so that one side of the finishing panel is stuck with both sides of inner edge of the corner, and a first coupling groove that is configured to extend in a lengthwise direction in an outer side of the first stopping protrusion so that the elastic coupling member fixedly combined to the finishing panel is inserted and combined, wherein the second column member further comprises a second stopping protrusion that is configured to extend in a lengthwise direction in one side of the second coupling groove so that one side of the finishing panel is stuck, wherein the edge column member and the second column member are combined in a way that a coupling piece provided at the other side of a widthwise direction of the second column member is inserted into a coupling groove provided at one side of a widthwise direction of the edge column member.

Further, the prefabricated wall may further comprise a column assembly that allows a wall consisted of the finishing panel combined with the plurality of studs to be crossed to each other, wherein the column assembly consists of a combination comprising at least one of; a first column member that is combined to one side of the finishing panel at an inner side of the corner consisted of the wall; and a second column member that is provided with a second coupling groove that is configured to extend in a lengthwise direction for the elastic coupling member which is fixedly combined to the finishing panel to be inserted and combined in one side of a widthwise direction, wherein the first column member comprises a first stopping protrusion that is configured to extend in a lengthwise direction so that one side of the finishing panel is stuck with both sides of inner edge of the corner, and a first coupling groove that is configured to extend in a lengthwise direction in an outer side of the first stopping protrusion so that the elastic coupling member which is fixedly combined to the finishing panel is inserted and combined, wherein the second column member further comprises a second stopping protrusion that is configured to extend in a lengthwise direction in one side of the second coupling groove so that one side of the finishing panel is stuck, wherein in case of use of the second column member, a coupling piece provided at the other side of a widthwise direction of the second column member is inserted into and combined with a coupling groove provided at the other side of a widthwise direction of another second column member.

The present invention also provides a construction method of a prefabricated wall for interior, and the construction method comprises Step (a): Disposing and installing a runner to face a ceiling and a floor, Step (b): Adhering a rear surface of a lengthwise direction end of each of a plurality of studs to a side surface of a widthwise direction of a mounting frame portion of the runner and then fixing it in a vertical direction, Step (c): Inserting a runner coupling piece of a washboard into a washboard coupling groove of the runner so that a washboard coupling portion of a molding member is inserted into a molding coupling groove of the washboard to allow the washboard that is combined to the molding member to be combined to both ends of a lengthwise direction of the runner, Step (d): Inserting a protruding portion of an elastic coupling member into a coupling groove of the studs so that a front surface portion of the plurality of studs is provided with a finishing panel that is fixedly coupled to both ends of left and right sides of an inner side surface thereof thereby the elastic coupling member extends in a vertical direction, Step (e): Installing an electric outlet or home appliances such as a TV, or a computer, or a flat panel display device, or a cooling/heating device, or a humidifier, or an air purifier in an opening of the finishing panel, and Step (f): Passing an insulated wire via a through hole formed on a top side portion of a mounting frame portion of a central portion of the runner into a space between rear surfaces of the stud fixed at both side surfaces of a widthwise direction of the mounting frame portion and into an internal space of the mounting frame portion so as to electrically connect to the home appliances or the electric outlet for a power supply, wherein the Step (d) further comprise step (d1) in which compressively installing a gapper in areas that are not finished by a panel side finishing wing of the elastic coupling member at an upper end portion and a lower end portion between the finishing panels, thereby filling to finish a gap between the finishing panels.

Further, the construction method may further comprise a step (g) in which a side end portion of a wall consisted of the finishing panel that is combined with the plurality of studs is coupled to one side of the column assembly so that the wall become adjacent to each other so as to form a corner or becomes crossed to each other.

Further, the construction method may further comprise a step (g) in which a side end portion of a wall consisted of the finishing panel that is combined with the plurality of studs is coupled to an end column member so as to finish the side end portion of the wall.

Advantageous Effects

A prefabricated wall for interior and its construction method can minimize the uses of screws, thus can facilitate the installation, disassembly and re-assembly of a wall.

Also, they can allow a small number of personnel to simultaneously perform the installation or disassembly work, reduce labor costs, and shorten the construction period.

Also, separate silicon finishing becomes unnecessary by a molding member that is combined and installed to a lower part of a washboard.

Also, it is possible that a wall is bent or crossed depending on preference by a combination comprising a first and a second corner column members and an edge column member, and that an installation is available without difficulty even in case that a wall is not perpendicular to or has a crossing angle that is somewhat away from a right angle.

Also, a sound-proof capacity is improved by installing a sound-proof member in a space between rear surfaces of the studs installed on both sides of the runner.

Also, an electric wiring is facilitated that is necessary for operation of electrical devices or home appliances installed on the finishing panel by passing an insulated wire through after perforating a top side portion of a mounting frame portion of a central portion of the runner, if needed.

Also, it is possible to install various electrical devices such as a TV, a computer, a flat panel display device, a humidifier, or an air purifier in an opening of the finishing panel, or install an electric outlet in necessary positions of the finishing panels for convenient use.

BEST MODE

According to one aspect, the present invention provides a prefabricated wall for interior which partitions an indoor space of a building, which is also a prefabricated wall partitioning an indoor space of a building, the prefabricated wall comprises a runner installed to face a ceiling and a floor; a plurality of studs vertically installed and fixed on both width-wise sides of the runner; and a finishing panel coupled to the plurality of studs, wherein each of the plurality of studs are provided with a pair of coupling grooves that is configured to extend in parallel to each other in a lengthwise direction, the finishing panel is provided with a pair of elastic coupling members which are fixedly coupled to both ends of left and right sides of an inner side surface of the finishing panel so as to extend in a vertical direction, and each of the pair of coupling grooves is provided on its left and right inner side surfaces with one or more stopping protrusion extending in a lengthwise direction, wherein each of the pair of elastic coupling members comprises a contact portion that adheres to the inner side surface of the finishing panel, and a protruding portion that is configured to protrude from the contact portion in an inward direction and extend in a lengthwise direction, wherein the protruding portion is provided on its central portion with a separation groove that forms concavely in a lengthwise direction such that a left side coupling piece and a right side coupling piece are formed on left and right sides of the separation groove, wherein one or more coupling projection is formed to extend in a lengthwise direction on a left side surface of a left coupling piece and a right side surface of a right coupling piece so as to be stuck with the one or more stopping protrusion, wherein each of the pair of elastic coupling members further comprises a panel side finishing wing portion that is bent from one end of the contact portion so as to encompass a side surface portion of the finishing panel and is configured to extend in a lengthwise direction, wherein the finishing panel is installed on a front surface portion of the plurality of studs by inserting and coupling the protruding portion of the elastic coupling members into the coupling grooves.

MODE FOR INVENTION

Hereinafter, preferred embodiments of the present invention will be described in detail with reference to the accompanying drawings as follows, and it should be understood that a scope of the present invention is not limited to nor defined by such embodiments.

The following is to explain a constitution of a prefabricated wall according to a preferred embodiment of the present invention.

Figure 1:
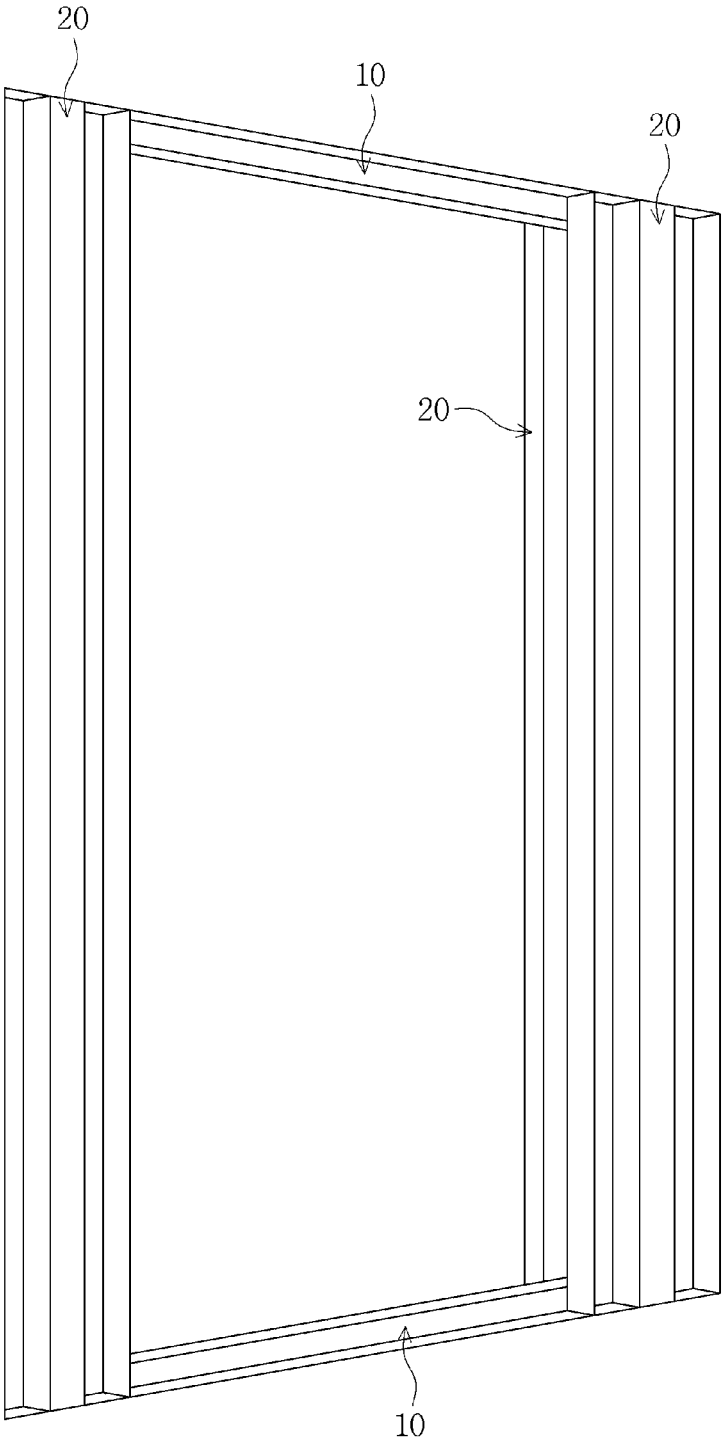
FIG. 1 is a perspective view in which a stud is installed and fixed to a runner provided in a ceiling and a floor.
Figure 4:
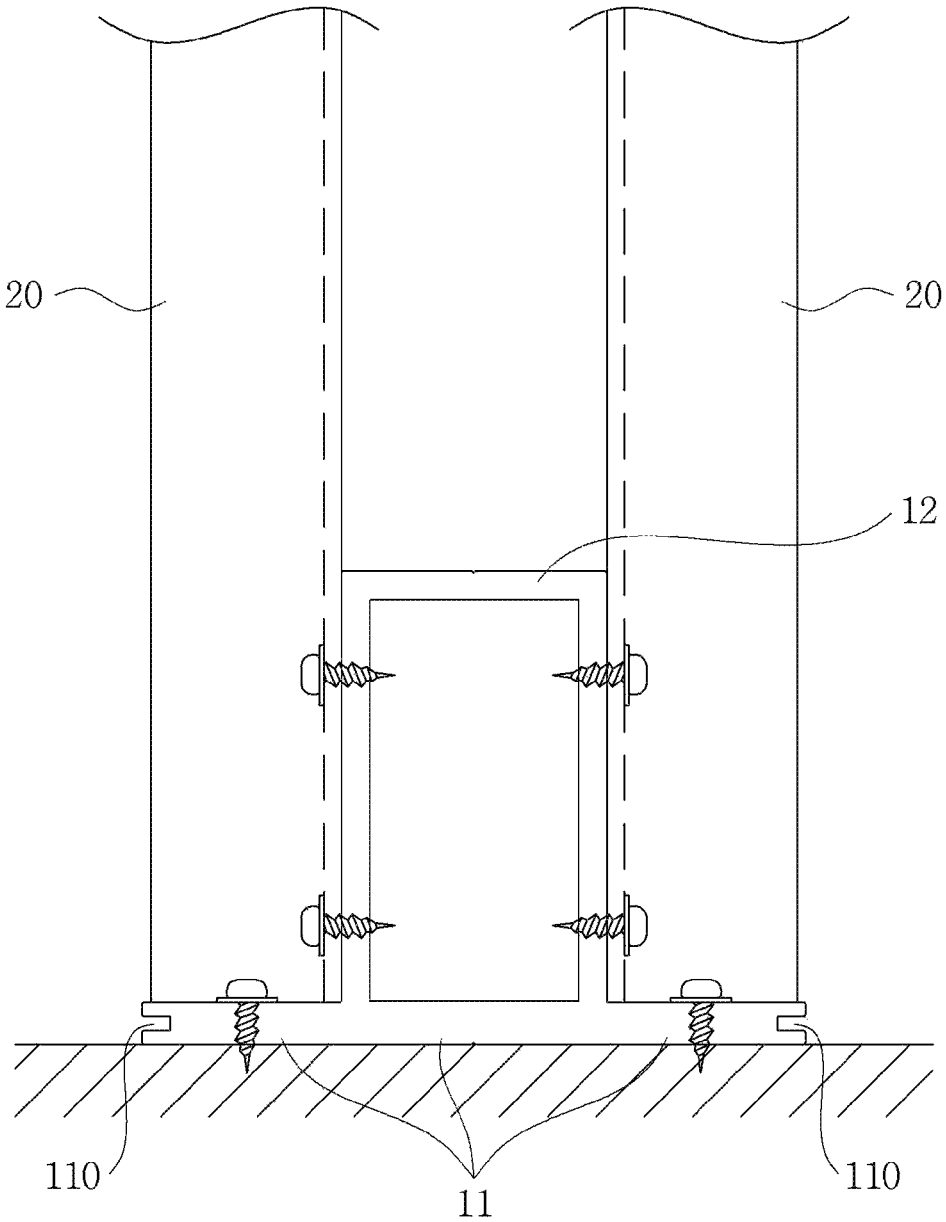
FIG. 4 is a side sectional view in which a stud is fixed at both sides of a widthwise direction of a runner installed on a floor.
Figure 6:
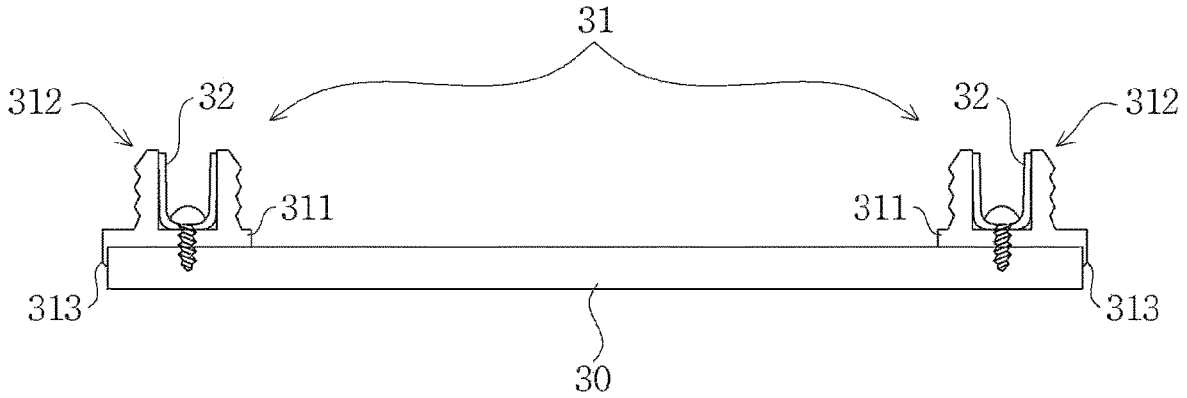
FIG. 6 is a sectional view of a finishing panel from a top in which an elastic coupling member is fixed at both ends of left and right sides of an inner side surface.
Figure 7:
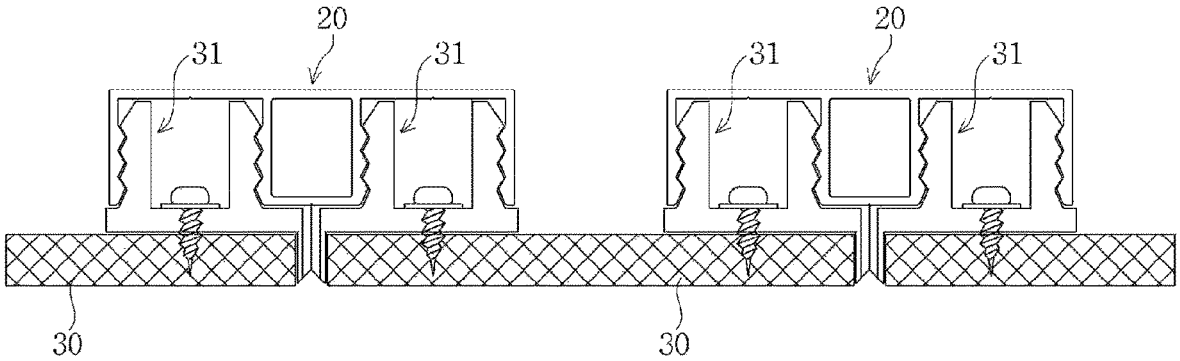
FIG. 7 is a sectional view from a top in which a plurality of finishing panels having an elastic coupling member fixed thereto is combined to a plurality of studs.
Figure 9:
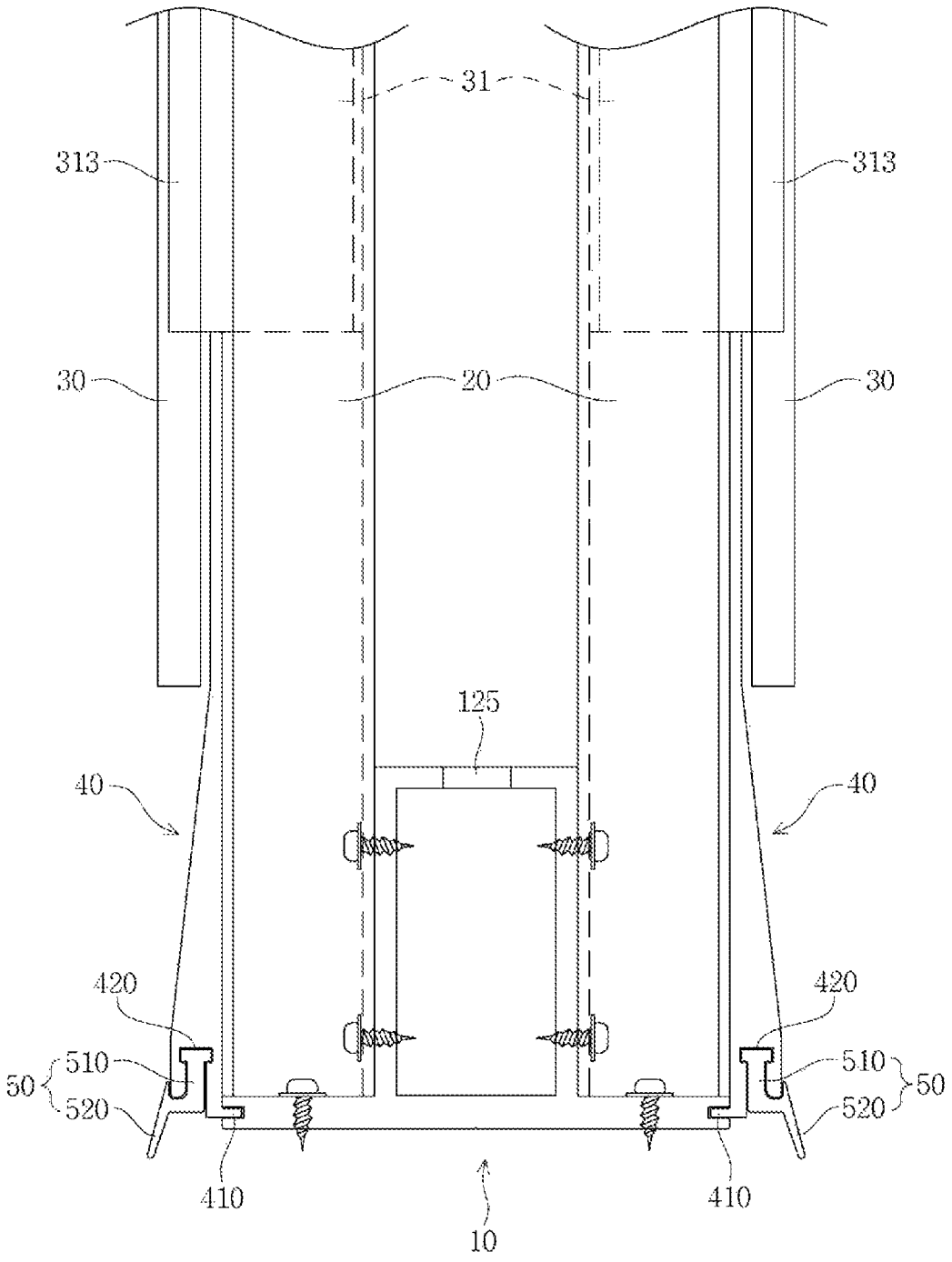
FIG. 9 is a side sectional view in which a runner, a stud, a finishing panel, an elastic coupling member, a washboard and a molding member are combined.
Figure 12:
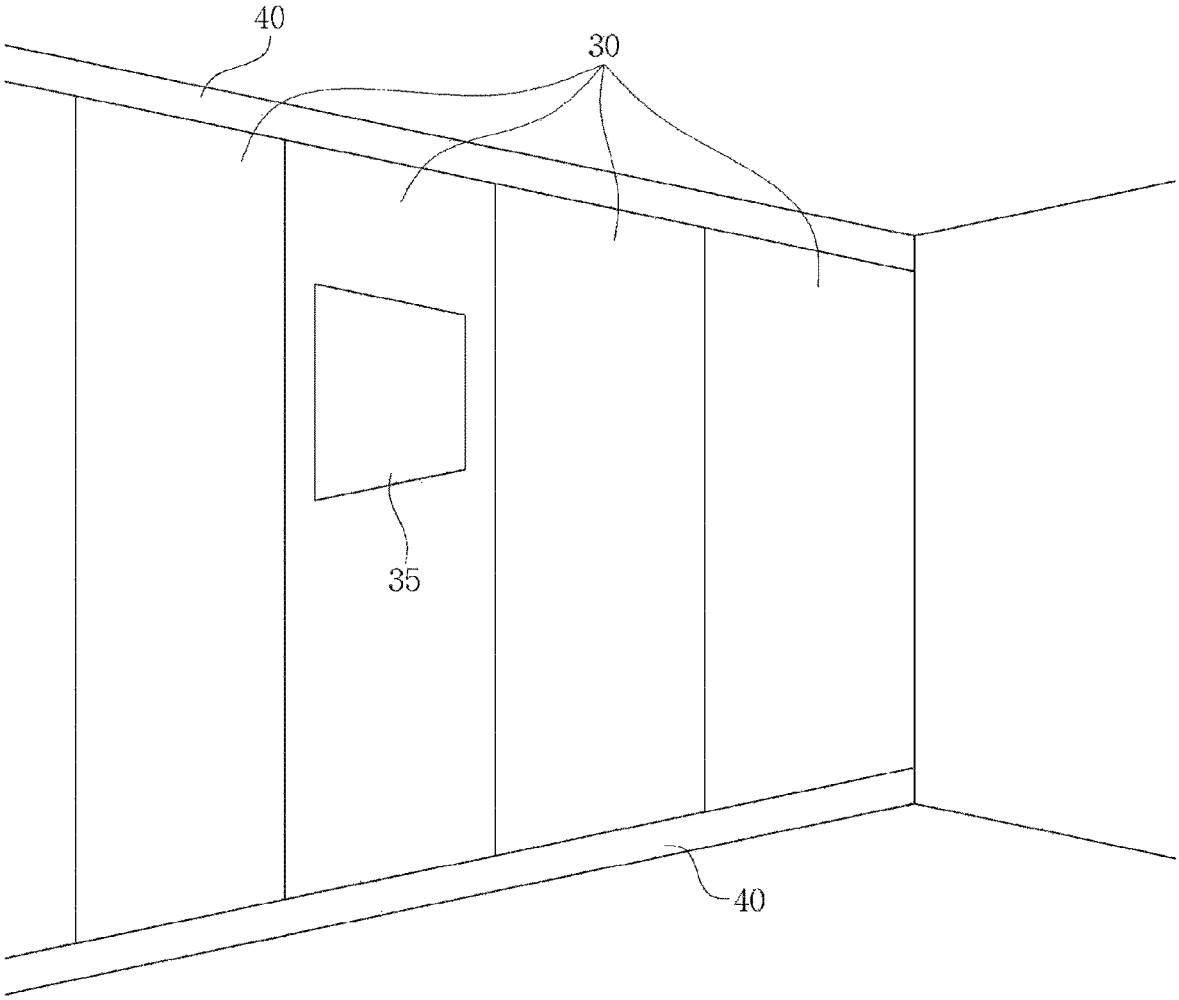
FIG. 12 is a perspective view in which an electrical device is installed in an opening of a finishing panel.

FIG. 1 is a perspective view in which a stud is installed and fixed to a runner provided in a ceiling and a floor, FIG. 4 is a side sectional view in which a stud is fixed at both sides of a widthwise direction of a runner installed on a floor, FIG. 6 is a sectional view of a finishing panel from a top in which an elastic coupling member is fixed at both ends of left and right sides of an inner side surface, FIG. 7 is a sectional view from a top in which a plurality of finishing panels having an elastic coupling member fixed thereto is combined to a plurality of studs, FIG. 9 is a side sectional view in which a runner, a stud, a finishing panel, an elastic coupling member, a washboard and a molding member are combined, and FIG. 12 is a perspective view in which an electrical device is installed in an opening of a finishing panel.

A prefabricated wall for interior according to the present invention comprises a runner 10 installed to face a ceiling and a floor, a plurality of studs 20 vertically installed and fixed on both width-wise sides of the runner 10, and a finishing panel 30 coupled to the plurality of studs 20, which is used to partition an indoor space of a building.

The runner 10 and the stud 10 are an element forming a frame work of a prefabricated wall according to the present invention.

Also, a finishing panel 30 is a planar plate style member, and forms most of side surface portions of the prefabricated wall for interior according to the present invention, and is installed on a front surface portion of the plurality of studs 20 fixed on both sides of the runner 10.

Such finishing panel 30 can be manufactured with several sizes and can adopt, for an example, a MDF panel or a form board having 1220 mm width and 2440 mm length, and an outer surface of the finishing panel 30 can be wrapping-treated by wrapping and covering with a film etc. having a variety of colors and patterns. Also, the finishing panel 30 can be configured to have enough width for sizes of electrical devices etc. installed in an opening 35.

As seen in FIG. 6 and FIG. 7, both ends of left and right sides of an inner side surface of the finishing panel 30 (an upper side surface of a finishing panel in FIG. 6 and FIG. 7) is provided with a pair of elastic coupling members 31 that are combined and fixed to extend in a vertical direction.

The finishing panel 30 is combined and installed to the plurality of studs 20 via such pair of elastic coupling members 31.

The elastic coupling members 31 will be explained in detail as below.

Figure 2:
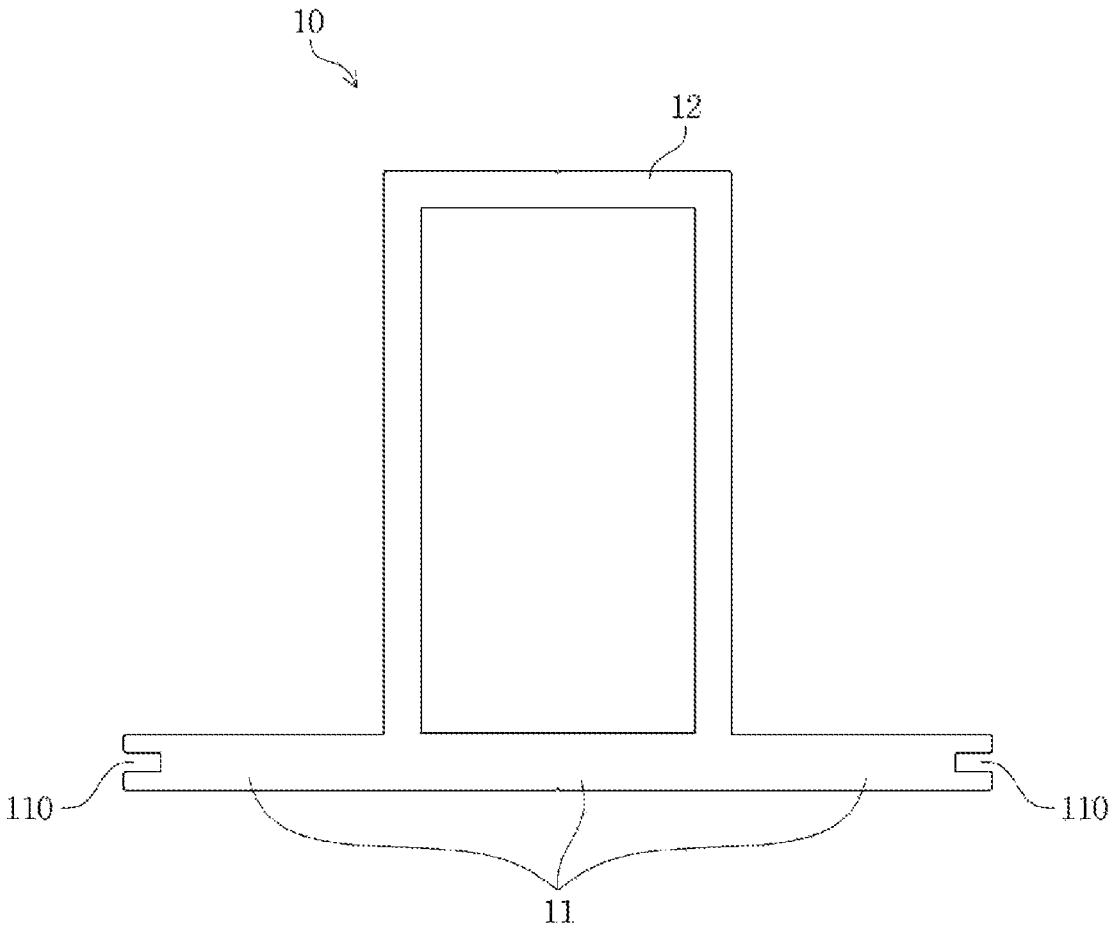
FIG. 2 is a sectional view of the runner.

The following description will explain the runner 10 in detail. FIG. 2 is a sectional view of the runner.

Runner 10 is a member that is fixed and installed to face a ceiling and a floor so as to fix upper and lower ends of a stud 20 in case of installing a prefabricated wall using a dry construction method, and comprises a base portion 11 and a mounting frame portion 12.

Base portion 11 adheres to a ceiling or a floor to be fixed by a screw etc. and is configured to have a certain width and enough length.

Also, a central portion of the opposite side to a part where the base portion 11 adheres to a ceiling or a floor is provided with a mounting frame portion 12 which protrudes to extend in a lengthwise direction and of which side surface is combined and fixed to an upper end or a lower end of the stud 20.

According to the present embodiment, the mounting frame portion 12 is shaped as generally hollow rectangular column form, however, the present invention is not limited thereto, and a hollow space is formed in a lengthwise direction inside the mounting frame portion 12, and both sides of the mounting frame portion 12 are configured to be parallel to each other while the upper side is inclined or forms a curved surface or is configured with a variety of shapes, and as seen in FIG. 9, an upper side portion of the mounting frame portion 12 can be provided with a through hole 125 through which an insulated wire passes for a power supply to home devices etc. installed in an opening 35 of the finishing panel 30.

In such mounting frame portion 12 a space distanced with the same widths as the mounting frame portion 12 between studs 20 fixed at both side surfaces thereof is formed, thereby by a sound proof material for improving a sound proof capacity of a wall is installed in a space between the studs 20 or the insulated wire is allowed to pass for a power supply to home devices etc. installed in an opening 35 of the finishing panel 30. Therefore, a width of the mounting frame portion 12 can be designed according to required sound proof capacity or to sizes of home devices etc. installed in an opening 35 of the finishing panel 30, in order to comply with a variety of requirements.

A stopping protrusion (not shown) can be configured to extend in a lengthwise direction that protrudes for each ends in a lengthwise direction of a plurality of studs 20 that are fixed to both side surfaces of the mounting frame portion 12 in a widthwise direction to be stuck, in an area where the base portion 11 and the mounting frame portion 12 meet.

As seen in FIG. 9, a runner 10 is installed in a way in which a base portion 11 is adhered to be fixed to a ceiling or a floor by a screw etc. at both sides that the mounting frame portion 12 is formed at, thus a head part of the screw is protruded from the base portion 11, and a stopping protrusion for a stud is shaped so as to be protruded higher that the head part of the screw so that when an end of the stud 20 is adhered to a side surface of the mounting frame portion 12 the end of the stud 20 cannot be stuck with the head of the screw and the stud 20 can be combined at a certain position.

In addition, even without the stopping protrusion for a stud, if a screw for adhering and fixing a base portion 11 to a ceiling or a floor is installed between a plurality of studs 20 that is installed and fixed at both sides of the base portion in a widthwise direction, interference between a head part of a screw and an end of the stud 20 can be prevented.

Also, a washboard coupling groove 110 to which a runner coupling piece 410 of a washboard 40 as explained below is inserted and combined is configured to extend in a lengthwise direction at both widthwise ends of the base portion 11.

The runner 10 having such configuration can be manufactured with a variety of materials, and it is generally preferred to manufacture with an aluminum- or an aluminum alloy material that is easy to process and is light weighted, and the runner is installed to face a predetermined position of ceiling and floor to partition an indoor space of building.

Detailed explanation for a stud 20 is given below.

Figure 3:
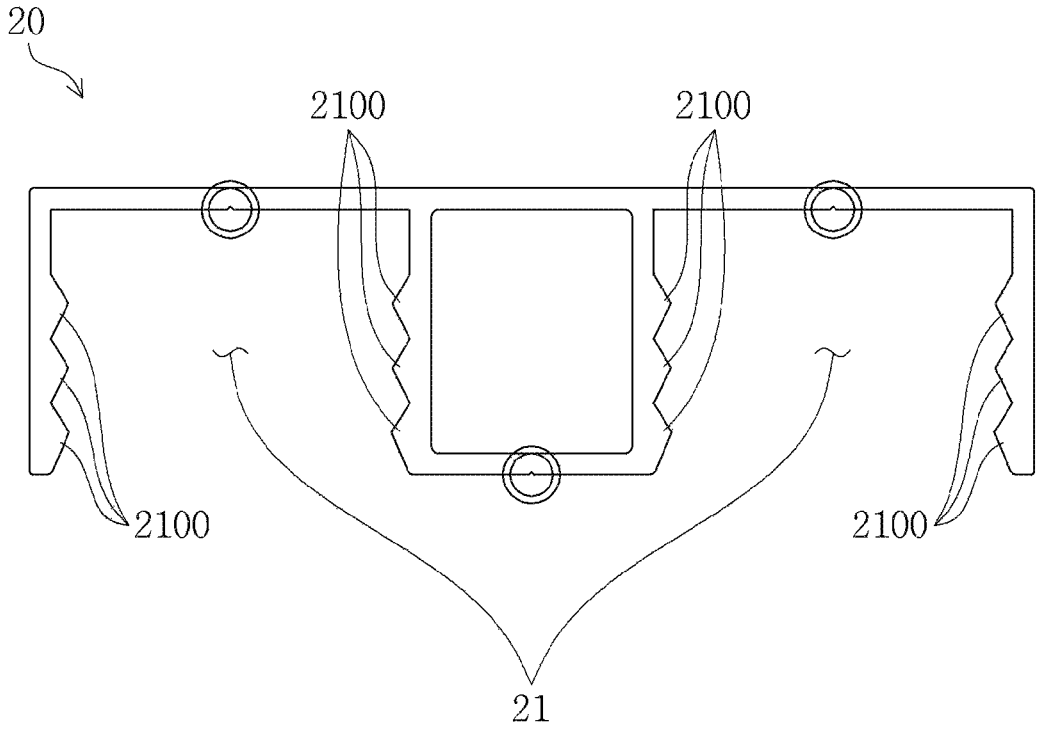
FIG. 3 is a top plan view of a stud.

FIG. 3 is a top plan view of a stud.

Stud 20 is a component which is combined and fixed to a runner 10 whose both ends in a lengthwise direction are installed and fixed to a ceiling and a floor, to form a frame to be connected to a finishing panel 30, and as seen in FIG. 1 and FIG. 4, the stud is combined and fixed with a screw etc. by adhering to both sides in a widthwise direction of a mounting frame portion 12 of a runner 10 that is installed and fixed to the ceiling and the floor.

As seen in FIG. 3, the stud 20 is provided with a pair of coupling grooves 21 to which a protruding portion 312 of an elastic coupling member 31 is inserted and combined, and such pair of coupling grooves 21 are configured at a front surface portion of the stud 20 (a lower side surface of the stud in FIG. 3) to extend in a lengthwise direction.

A left inner side and a right inner side of the pair of coupling grooves 21 are provided with one or more stopping protrusion 2100 configured to extend in a lengthwise direction.

In addition, considering that the stud 20's length is relatively longer that its width in its shape and the stud 20 installed and fixed in a vertical direction is short for a strength in a transverse direction, appropriate reinforcing member (not shown) is installed and fixed in a horizontal direction between the plurality of studs 20 installed in a vertical direction so as to strengthen a capacity in a transverse direction for the studs 20.

The stud 20 having such configuration can be manufactured with a variety of materials, and it is generally preferred to manufacture with an aluminum- or an aluminum alloy material that is easy to process and is light weighted.

Figure 5:
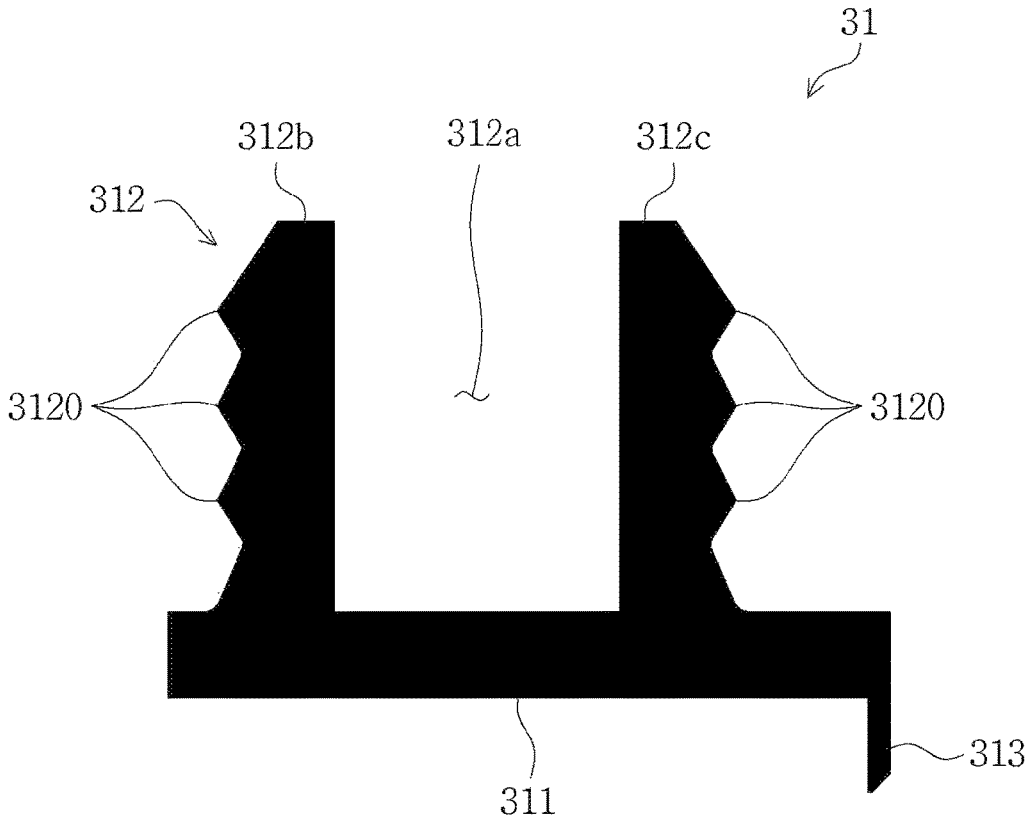
FIG. 5 is a sectional view of an elastic coupling member.

Detailed explanation for an elastic coupling member 31 is given below. FIG. 5 is a sectional view of an elastic coupling member.

Elastic coupling member 31 is a component which is combined and fixed to extend in a vertical direction at both ends of left and right of inner side surface of the finishing panel 30 thereby in order to be inserted into a coupling groove 21 of the stud 20, so that the finishing panel 30 is combined to a plurality of studs 20, and comprises a contact portion 311 and a protruding portion 312.

The contact portion 311 is a portion that adheres to an inner side surface of the finishing panel 30, and the protruding portion 312 is a portion that is inserted and combined to a coupling groove 21 of the stud 20 and is configured to protrude inward (an upper side from FIG. 5) from the contact portion 311 to extend in a lengthwise direction.

As seen in FIG. 5, the protruding portion 312 is provided on its central portion with a separation groove 312*a* that forms concavely in a lengthwise direction such that a left side coupling piece 312*b* and a right side coupling piece 312*c* are formed on left and right sides of the separation groove 312*a*.

The separation groove 312*a* is configured to have an approximate rectangular section, and left side and right side surfaces of the separation groove 312*a* may be configured to be parallel to each other and also is preferred to be configured to be inclined outward at around 2 to 5 degrees in order to prevent a reduction in a restoring force of the left side coupling piece 312*b* and the right side coupling piece 312*c* due to a reduction in elasticity.

Also, one or more coupling projection 3120 is formed to extend in a lengthwise direction on a left side surface of the left coupling piece 312*b* and a right side surface of the right coupling piece 312*c* so as to be stuck with the stopping protrusion 2100.

Although not seen in FIG. 7, the stopping protrusion 2100 of the stud 20 and the coupling projection 3120 of the elastic coupling member 31 that are stuck to each other are preferred to be configured to be inclined in one direction so that the protruding portion 312 is easy to be inserted to the coupling groove 21 but the protruding portion 312 is difficult to be separated from the coupling groove 21.

Also, the elastic coupling member 31 may further comprise a panel side finishing wing portion 313 to encompass a side surface portion of the finishing panel 30. Such panel side finishing wing portion 313 is configured to be bent from one end of the contact portion 311 so as to encompass a side surface portion of the finishing panel 30 and to extend in a lengthwise direction when the elastic coupling member 31 is combined and fixed to both ends of left and right sides of an inner side surface of the finishing panel 30.

Thus, when a plurality of finishing panels 30 to which an elastic coupling member 31 is coupled and fixed is continuously connected to a plurality of studs 20, as seen in FIG. 7, a panel side finishing wing portion 313 contacts and adheres to each other between the finishing panels 30 adjacent to each other.

Such elastic coupling member 31 is manufactured with synthetic resins etc. having sufficient elasticity, for example may be manufactured with a rubber material having a hardness of 5.5.

The elastic coupling member 31 is fixed to an inner side surface of the finishing panel 30 by using a screw or a nailer etc. at a lower side portion of the separation groove 312*a*.

However, the elastic coupling member 30 is configured to be a little shorter than the finishing panel 30 in their length to be fixed to the finishing panel, as seen in FIG. 9, it is preferred that an upper portion of a washboard 40 as explained below is positioned inside of a lower portion of the finishing panel 30.

In addition, as seen in FIG. 6, the elastic coupling member 31 may be fixed by a screw or a nailer etc. to an inner side surface of the finishing panel 30 together with an elastic piece 32 in a state that the elastic piece 32 to prevent a reduction in a restoring force due to a reduction in elasticity of the left side coupling piece 312*b* and the right side coupling piece 312*c* is being inserted into the separation groove 312*a*.

The elastic piece 32 may be configured to extend in a lengthwise direction with a "U" shaped section using a metal material etc. having a high elasticity such as a spring steel, but the present invention is not limited thereto and may be formed with a variety of sectional shapes that can prevent a reduction in a restoring force due to a reduction in elasticity of the left side coupling piece 312*b* and the right side coupling piece 312*c*.

The prefabricated wall for interior according to the present invention may further comprise a gapper 80.

Figure 10:
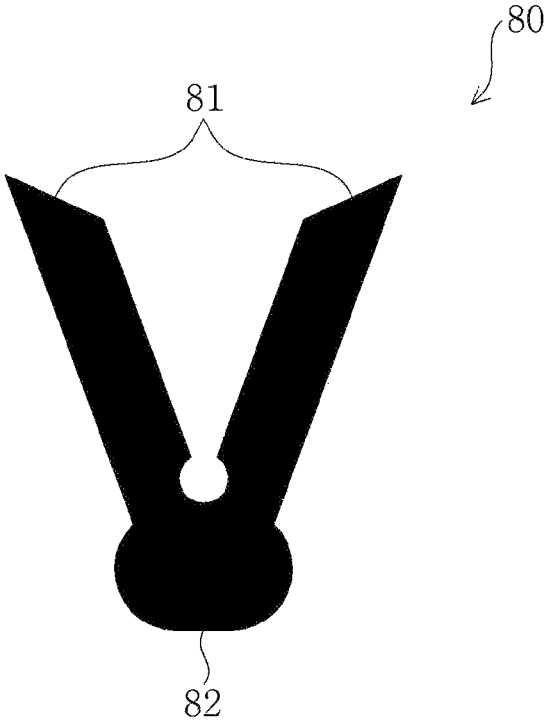
FIG. 10 is a sectional view of a gapper.
Figure 11:
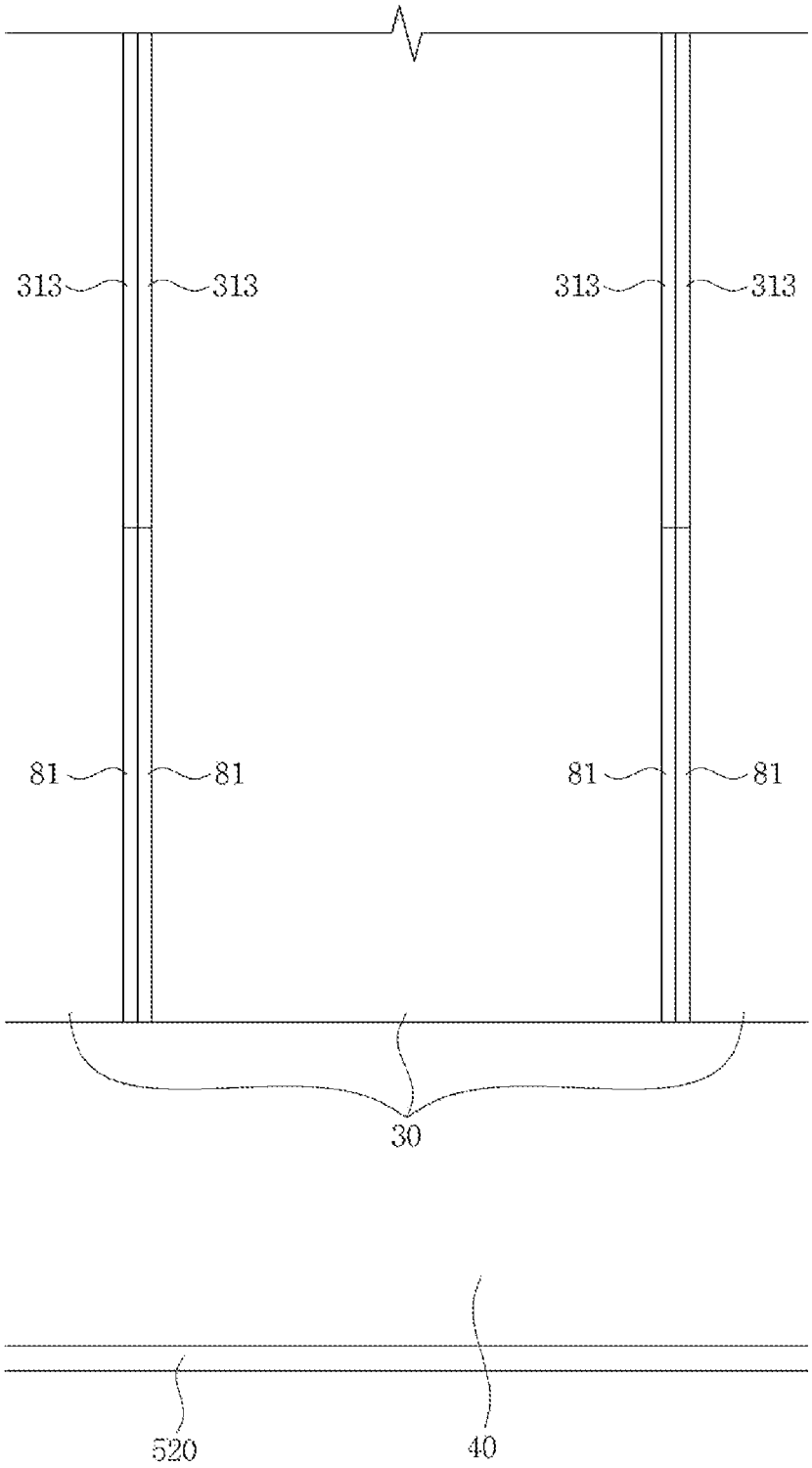
FIG. 11 is a front view of a prefabricated wall in which a gapper is compressively installed between a plurality of finishing panels.

FIG. 10 is a sectional view of a gapper and FIG. 11 is a front view of a prefabricated wall in which a gapper is compressively installed between a plurality of finishing panels.

Gapper 80 is a component which is configured to be compressed and installed between a plurality of finishing panels 30 forming a side surface portion of the prefabricated wall of the present invention in order to block and finish between the finishing panels 30 adjacent to each other, and the gapper 80 comprises a pair of panel side compressing pieces 81 and a center connecting portion 82.

Basically, the plurality of finishing panels 30 to which the elastic coupling member 31 is combined and fixed is continuously connected to a plurality of studs 20, so that a panel side finishing wing portion 313 contacts and adheres to each other between the finishing panels 30 adjacent to each other thereby a gap is filled to be then finished (See FIG. 7).

However, as explained above, the elastic coupling member 30 is configured to be a little shorter than the finishing panel 30 in their length to be fixed to the finishing panel 30, thus there exist areas that are not finished by a panel side finishing wing 313 at an upper end portion and a lower end portion between the finishing panels 30 adjacent to each other, and the gapper 80 is used to fill to finish such unfinished gap.

A pair of panel side compressing pieces 81 are parts each of which contacts a side portion of the finishing panel 30 and have approximately planar shapes and are configured to extend in a lengthwise direction, and preferably are configured to be arranged about 4 to 10 degree with a center connecting portion 82 as a center in a state that the gapper 80 is not deformed.

A center connecting portion 82 is a part to connect an end of the pair of panel side compressing pieces 81, in the course of installing a gapper 80 between finishing panels 30 adjacent to each other, each of a pair of panel side compressing pieces 81 is moved into the middle to be compressed by a side surface portion of the finishing panel 30 with the center connecting portion 82 as a center (See FIG. 11).

In FIG. 10, it is shown that a width of the center connecting portion 82 is larger than an aggregated thickness of the pair of panel side compressing pieces 81, however, the center connecting portion 82 is not necessarily formed to have a distinguishing outer appearance as such, but to be manufactured with a variety of shapes (non-distinguishing outer appearance over the panel side compressing piece) as long as the pair of panel side compressing pieces 81 can be connected with sufficient strength.

Such gapper 80 is manufactured to have enough length, which is then cut with the same length as areas not finished by a panel side finishing wing 313 at an upper end portion and a lower end portion between the finishing panels 30 adjacent to each other and is then compressively installed between the finishing panels 30 adjacent to each other.

Also, the gapper 80 is manufactured with synthetic resins etc. having sufficient elasticity, for example may be manufactured with a rubber material having a hardness of 5.5.

The prefabricated wall for interior according to the present invention may further comprise a washboard 40 and a molding member 50.

Figure 8:
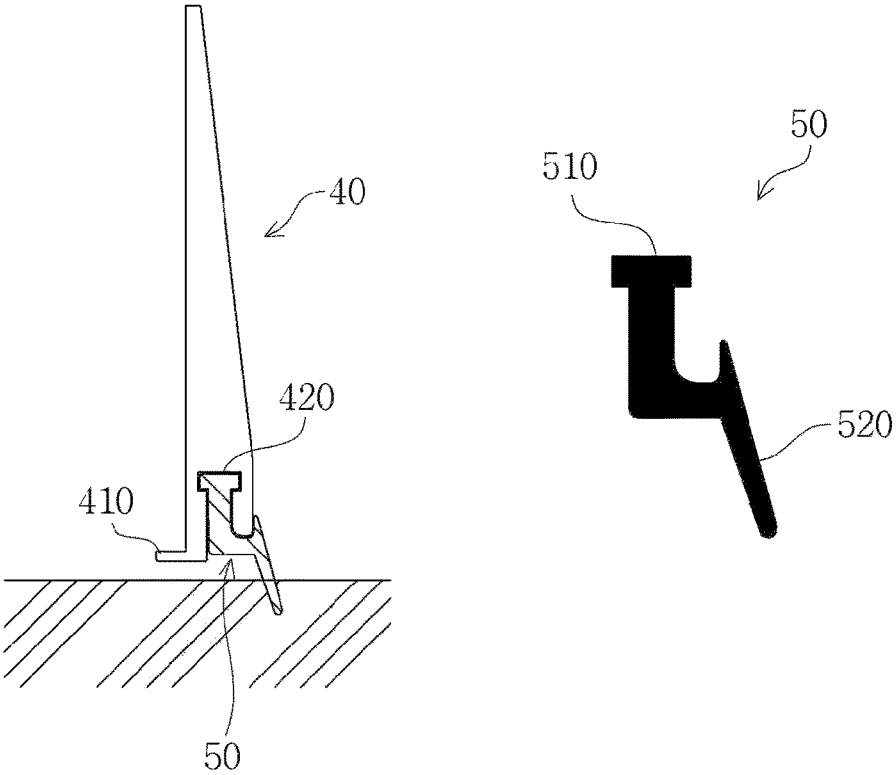
FIG. 8 is a side sectional view of a washboard and a molding member.

FIG. 8 is a side sectional view of a washboard and a molding member.

Washboard 40 is a component which is occluding an area from a ceiling or a floor to a position that the finishing panel 30 is installed (See FIG. 12), and the washboard comprises a runner coupling piece 410 and a molding coupling groove 420 and is formed as generally long rectangular plate shape.

The runner coupling piece 410 is a part that is inserted into a washboard coupling groove 110 of the runner 10 such that the washboard 40 is combined to both sides of the runner 10 in a widthwise direction, and the runner coupling piece is configured to be bent inward (left direction of FIG. 8) from an end of a direction (downward direction of FIG. 8) adjacent to a ceiling or a floor of the washboard 40 to extend in a lengthwise direction.

The molding coupling groove 420 is a part into which a washboard coupling portion 510 of a molding member 50 as explained below is inserted and combined, and is configured to extend in a lengthwise direction at an end of a direction (downward direction of FIG. 8) adjacent to a ceiling or a floor of the washboard 40.

FIG. 8 shows that a molding coupling groove 420 is open into a downward direction at an end of a direction adjacent to a ceiling or a floor of the washboard 40, but the present invention is not necessarily limited thereto, and the molding coupling groove 420 can be open into an outward direction (right direction of FIG. 8) at an end of a direction adjacent to a ceiling or a floor of the washboard 40. In this case, a washboard coupling portion 510 of the molding member 50 is also configured to have a corresponding sectional shape.

Such molding coupling groove 420 is formed as a dovetail shape or a "T" shaped section so that a washboard coupling portion 510 configured to have a corresponding sectional shape is inserted into a molding coupling groove 420, then preferably it should be difficult to be separated.

The washboard 40 can be manufactured with a variety of materials, and it is generally preferred to manufacture with an aluminum- or an aluminum alloy material that is easy to process and is light weighted.

A molding member 50 is a component to function as covering between one end of the washboard 40 and a ceiling or a floor and comprises a washboard coupling portion 510 and a corner finishing portion 520.

The washboard coupling portion 510 is a part that is inserted into a molding coupling groove 420 of a washboard 40 so that the molding member 50 is connected to one side of the washboard 40, and is configured to extend in a lengthwise direction with a dovetail shape or a "T" shaped section at one side of a molding member 50.

A corner finishing portion 520 is a part that allows a corner portion between one end portion of a washboard 40 and a ceiling or a floor to be covered like in a silicon finishing treatment in the course of installing a washboard 40, and is configured to be inclined from one end of a washboard coupling portion 510.

Also, where a washboard 40 is connected to a runner 10, to ensure to more positively contact with a ceiling or a floor, the corner finishing portion 520 is preferably inclined at a degree closer to a vertical direction than 45 degree.

Thus, where a washboard 40 to which a molding member 50 is connected is installed to both ends in a widthwise direction of a runner 10 that is fixed to a ceiling or a floor, one side of a corner finishing portion 520 in a widthwise direction contacts one end portion of a washboard 40 while the other side contacts a ceiling or a floor.

Such molding member 50 may be manufactured with a synthetic resin etc. having sufficient elasticity and flexibility and preferably with a rubber material having low hardness.

A prefabricated wall for interior according to the present invention may further comprise a column assembly 60.

Figure 13:
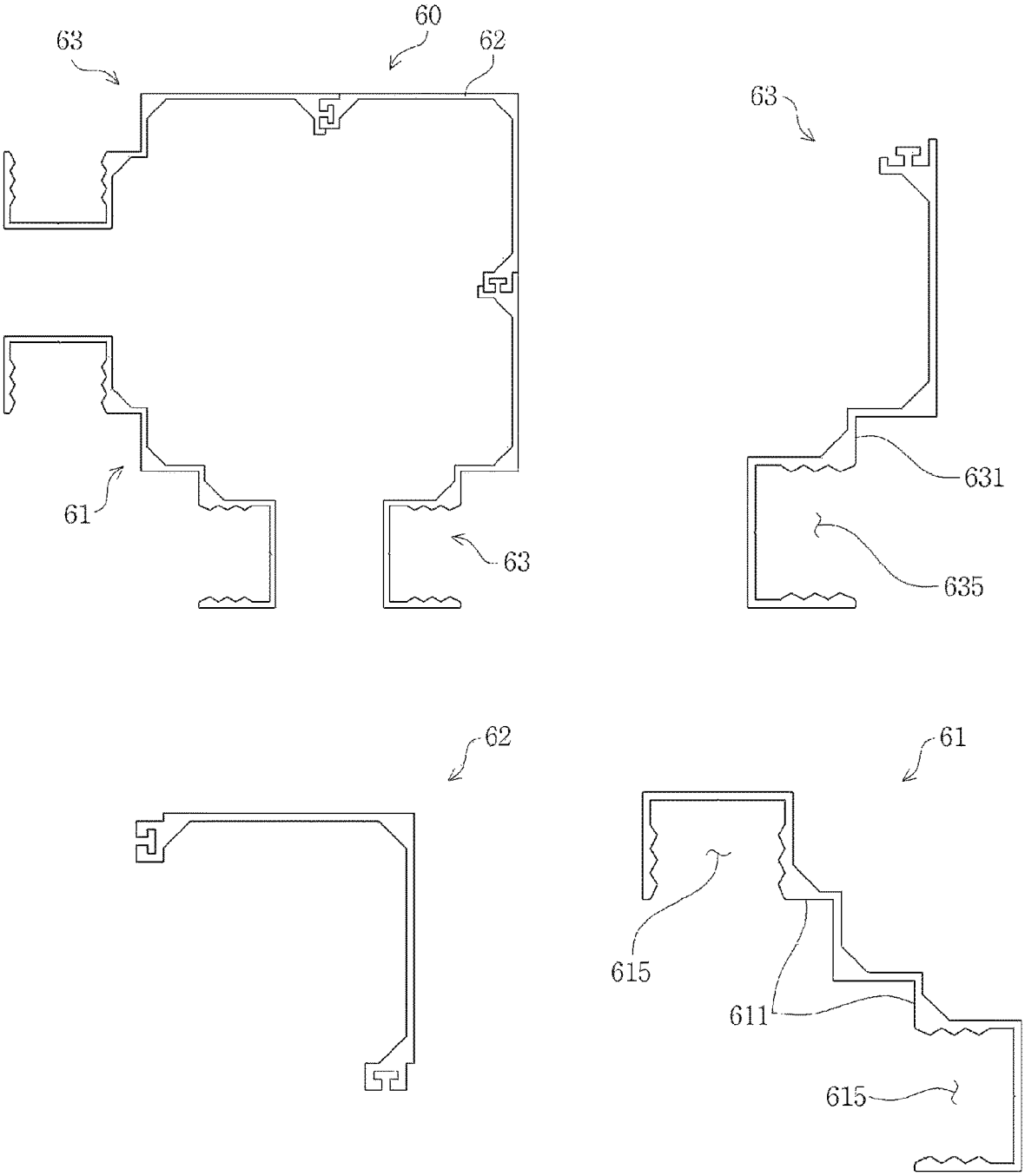
FIG. 13 is a sectional view from a top of a column assembly and a first column member, an edge column member and a second column member.
Figure 14:
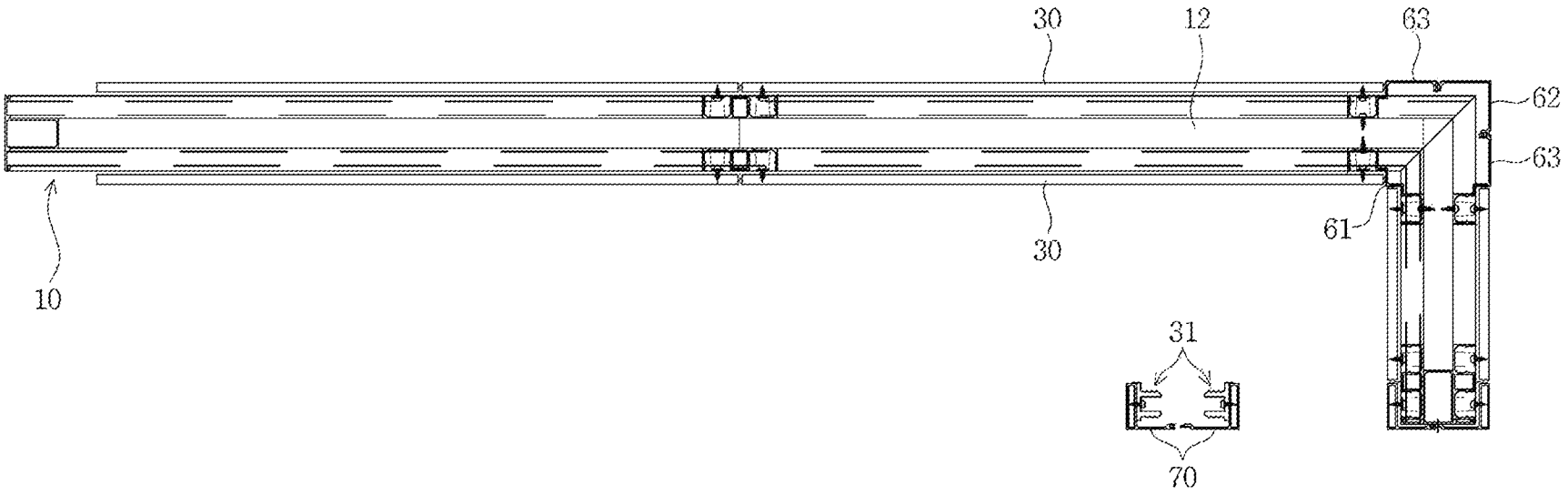
FIG. 14 is sectional view from a top in which a wall is bent and finished by a column assembly and an end column member.

FIG. 13 is a sectional view from a top of a column assembly and a first column member, an edge column member and a second column member, and FIG. 14 is sectional view from a top in which a wall is bent and finished by a column assembly and an end column member.

A column assembly 60 is a component which allows a wall consisted of the finishing panel 30 combined with the plurality of studs 20 to be crossed or to be adjacent to each other in order to form a corner, and it consists of a combination comprising at least one of a first column member 61, an edge column member 62 and a second column member 63.

A first column member 61 is a member which is combined to one side of a finishing panel 30 at an inner side of the corner formed by the walls being adjacent to each other which is consisted of the finishing panel 30 connected to a plurality of studs 20, and, as seen in FIG. 11, it comprises a first stopping protrusion 611 that is configured to extend in a lengthwise direction at both sides of an inner edge and a first coupling groove 615 that is configured to extend in a lengthwise direction in an outer side of the first stopping protrusion 611.

A first stopping protrusion 611 is a part which one side of the finishing panel 30 forming a wall is stuck to, and a first coupling groove 615 at its outer side is a part to which a protruding portion 312 of an elastic coupling member 31 that is connected and fixed to a finishing panel 30 is configured to be inserted and combined.

Also, one or more stopping protrusion extending in a lengthwise direction is provided with both inner side surfaces of a first coupling groove 615, thereby one or more coupling projection 3120 formed on a left side surface of a left coupling piece 312*b* and a right side surface of a right coupling piece 312*c* becomes stuck with one or more stopping protrusion of an inner side surface of a first coupling groove 615 in inserting of a protruding portion 312.

A second column member 63 is a member which is combined, at one side thereof in a widthwise direction, with one side of a finishing panel 30 forming a wall, and at the other side, with one side of a widthwise direction of an edge column member 62 as explained below, and comprises a second coupling groove 635 that is configured to extend in a lengthwise direction in one side of a widthwise direction and a second stopping protrusion 631 that is configured to extend in a lengthwise direction in one side of a second coupling groove 635.

A second stopping protrusion 631 is a part which one side of the finishing panel 30 forming a wall is stuck to, and a second coupling groove 635 at its outer side is a part to which a protruding portion 312 of an elastic coupling member 31 that is connected and fixed to a finishing panel 30 is configured to be inserted and combined.

Also, one or more stopping protrusion extending in a lengthwise direction is provided with both inner side surfaces of a second coupling groove 635, thereby one or more coupling projection 3120 formed on a left side surface of a left coupling piece 312*b* and a right side surface of a right coupling piece 312*c* becomes stuck with one or more stopping protrusion of an inner side surface of a second coupling groove 635 in inserting of the a protruding portion 312.

Also, the other side in a widthwise direction of a second column member 63 with which one side in a widthwise direction of an edge column member 62 is combined has a coupling piece extending in a lengthwise direction formed as a dovetail shape or a "T" shaped section so that it is preferred to be difficult to be separated after being inserted into a coupling groove configured to have a corresponding sectional shape to both side ends in a widthwise direction of an edge column member 62.

An edge column member 62 forms an outer edge of a corner formed by the walls being adjacent to each other and has an approximate "⌉" shaped sectional configuration and is configured to extend in a lengthwise direction, and at each of both sides in a widthwise direction thereof a coupling groove to which a coupling piece of the other side of a second column member 63 in a widthwise direction is inserted and combined is configured to be a dovetail shape or a "T" shaped section and to extend in a lengthwise direction.

In addition, although it is described above that a coupling piece is formed in the other side of a second column member 63 in a widthwise direction and a coupling groove is formed in both sides of an edge column member 62 in a widthwise direction, the present invention is not limited thereto, and it is also possible that a coupling groove is formed in the other side of a second column member 63 in a widthwise direction and a coupling piece is formed in both sides of an edge column member 62 in a widthwise direction and that a coupling groove is formed in one side of an edge column member 62 in a widthwise direction and a coupling piece is formed in the other side.

Where one of a first column member 61 and two of second column members 63 and one of an edge column member 62 are combined and form a column assembly 60, a wall may form a corner that is bent with "⌉" shape as seen in FIG. 14.

Also, where two of first column members 61 and two of second column members 63 are combined and form a column assembly 60 a wall may be configured to be crossed with "T" shape, and where four of first column members 61 are combined and form a column assembly 60 a wall may be configured to be crossed with "+" shape.

Here, where a wall may be configured to be crossed with "T" shape, a coupling piece formed on the other side in a widthwise direction of one second column member 63 of two second column members 63 is inserted and combined to a coupling groove formed on the other side in a widthwise direction of the other second column members 63.

As described above, a column assembly 60 consists of a combination comprising at least one of a first column member 61, an edge column member 62 and a second column member 63, thereby a wall may be bent or crossed depending on preference and an installation is available without difficulty even in case that a wall is not perpendicular to or has a crossing angle that is somewhat away from a right angle.

A prefabricated wall for interior according to the present invention may further comprise an end column member 70.

As seen in FIG. 14, an end column member 70 is a member that is coupled to a side end portion of a wall consisted of a finishing panel 30 which is combined with a plurality of studs 20 so as to finish an end portion of the wall, and has an approximate "⌉" shaped sectional configuration and extends in a lengthwise direction, and an inner surface of one side in a widthwise direction is combined and fixed to an elastic coupling member 31. Thus, a protruding portion 312 of an elastic coupling member 31 is inserted into a coupling groove 21 of a stud 20 thereby an end column member 70 is combined to a stud 20.

Also, a coupling piece or a coupling groove is formed at the other side end in a widthwise direction to be combined with a coupling piece or a coupling groove formed at one side end of other end column member 70 in a widthwise direction. Here, a coupling piece or a coupling groove is formed as a dovetail shape or a "T" shaped section to extend in a lengthwise direction, and preferably it should be difficult to be separated from each other once combined.

A construction method of a prefabricated wall for interior according to the present invention is explained as below.

First, a runner 10 should be installed to face each other in a predetermined position of a ceiling and a floor as per a design specification. That is, a reference line is indicated on a ceiling or a floor, and a runner 10 is adhered to a ceiling or a floor according to indicated reference line, then a base portion is fixed by a screw etc. at both sides of an area where a mounting frame portion 12 is formed.

Also, a plurality of studs 20 are fixed between runners 10 each of which is fixed to a ceiling and a floor. That is, a rear surface of a lengthwise direction end of each of a plurality of studs 20 is adhered to a side surface of a widthwise direction of a mounting frame portion 12 of the runner 10, and then is fixed in a vertical direction by a screw etc.

Then, a washboard coupling portion 510 of a molding member 50 is inserted into a molding coupling groove 420 of a washboard 40 so that a washboard 40 combined to a molding member 50 is connected to both ends of a runner 10 in a widthwise direction. That is, a runner coupling piece 410 of a washboard 40 is inserted into a washboard coupling groove 110 of a runner 10 so that a washboard 40 is combined to both ends of a runner 10 in a widthwise direction, thereby a washboard 40 combined to a molding member 50 is installed to an area adjacent to a ceiling and a floor and a corner finishing portion 520 of a molding member 50 contacts a ceiling and a floor.

Then, a front surface portion of a plurality of studs 20 is provided with a finishing panel 30 to which an elastic coupling member 31 is fixedly coupled in a vertical direction at both ends of left and right sides of an inner side surface thereof. That is, a protruding portion 312 of an elastic coupling member 31 fixed at both side ends of a finishing panel 30 is inserted into a coupling groove 21 of a plurality of studs 20 so that a finishing panel 30 is combined to a front surface portion of a plurality of studs 20, thereby a side surface portion of a prefabricated wall for interior according to the present invention is completed.

Here, an elastic coupling member 30 which is combined and fixed to both ends of left and right sides of an inner side surface of a finishing panel 30 is configured to be a little shorter than the finishing panel 30 in their length, thus, in the course of combining a finishing panel 30 with a front surface portion of a plurality of studs 20 it is prevented that a lower end portion of an elastic coupling member 30 which is combined and fixed to both ends of left and right sides of an inner side surface of a finishing panel 30 is supported by an upper portion of a washboard positioned at a lower inner side of a finishing panel, thereby it is prevented that a finishing panel 30 slips down into a lower side in a lengthwise direction of a stud 20 installed in a vertical direction.

In addition, in case that a plurality of finishing panels 30 should be combined to a front surface portion of a plurality of studs 30 due to that a length of a pre-ready finishing panel 30 is shorter than a height of indoor space, another finishing panel 30 is installed on an upper side of a finishing panel 30 installed on a lower side, thereby a finishing panel of an upper side is supported by a finishing panel 30 of a lower side.

Also, a step of compressively installing a gapper 80 in areas that are not finished by a panel side finishing wing 313 at an upper end portion and a lower end portion between finishing panels 30 adjacent to each other may be further included.

Such installing a gapper 80 can fill to finish a gap between finishing panels 30 adjacent to each other without omission.

In addition, where a home appliance or an electric outlet etc. is necessary to be installed on a side surface portion of a wall during the process, a step of installing them may be added.

First, an opening 35 of a finishing panel 30 is provided with an electric outlet or home appliances such as a TV, or a computer, or a flat panel display device, a cooling/heating device, or a humidifier, or an air purifier.

Next, an insulated wire is electrically connected to the home appliances or the electric outlet etc. for a power supply. That is, an insulated wire is passed via a through hole 125 formed on a top side portion of a mounting frame portion 12 of a central portion of a runner 10 into a space between rear surfaces of a stud 20 fixed at both side surfaces of a widthwise direction of the mounting frame portion 12 and into an internal space of the mounting frame portion 12 so as to electrically connect an insulated wire to the home appliances or the electric outlet etc.

Although it is described in the above that an insulated wire is electrically connected to the home appliances or the electric outlet etc. after an opening 35 of a finishing panel 30 is provided with an electric outlet or home appliances etc., it is also possible that an opening 35 of a finishing panel 30 is provided with an electric outlet or home appliances etc. and an insulated wire may be electrically connected to the home appliances or the electric outlet after an insulated wire is passed via a through hole 125 into a space between rear surfaces of a stud 20 fixed at both side surfaces of a widthwise direction of the mounting frame portion 12 and into an internal space of the mounting frame portion 12.

In addition, where it is required that walls are adjacent to each other to form a corner or be crossed to each other for partitioning indoor space of a building, a column assembly 60 consisted of a combination comprising at least one of a first column member 61, an edge column member 62 and a second column member 63 is combined to a side end portion of a wall. That is, a protruding portion 312 of an elastic coupling member 31 fixed to a side end portion of a finishing panel 30 forming a wall is inserted into a first coupling groove 615 or a second coupling groove 635 in order to be combined to a column assembly 60, thereby walls are adjacent to each other to form a corner or be crossed to each other.

Also, where an end portion of a wall is required to be finished, an end column member 70 is combined to a side end portion of a wall consisted of a finishing panel 30. That is, a protrusion portion 312 of an elastic coupling member 31 which is connected and fixed to an inner surface of one side in a widthwise direction of an end column member 70 is inserted and combined into a coupling groove 21 of a stud 20 to finish an end of a wall.

The above explained construction process may be conducted at once by a minimum number of workers. An existing prefabricated wall may not be completed with simple assembling only but separately requires different properties of actions such as finishing treatment with silicon of a corner portion between one end of a washboard and a ceiling or a floor, thus such whole processes should be conducted by different workers. Therefore, it should take additional time of working for such different workers to arrive and conduct the rest of actions after assembling actions are completed, which raises a problem to increase a construction period. However, a prefabricated wall for interior according to the present invention can be worked at once by a small number of personnel, and reduce labor costs and shorten a construction period.

It is one of advantages that a prefabricated wall for interior according to the present invention minimizes the uses of screws to then facilitate installation, disassembly and re-assembly of a wall.

Also, a small number of personnel may simultaneously perform the installation or disassembly work to reduce labor costs, and shorten the construction period.

Also, it is advantageous that separate silicon finishing becomes unnecessary by a molding member that is combined and installed to a lower part of a washboard.

Also, it is advantageous that a wall is bent or crossed depending on preference by a combination comprising a first and a second corner column members and an edge column member, and that an installation is available without difficulty even in case that a wall is not perpendicular to or has a crossing angle that is somewhat away from a right angle.

Also, it is advantageous that a sound-proof capacity is improved by installing a sound-proof member in a space between rear surfaces of the studs installed on both sides of the runner.

Also, it is advantageous that an electric wiring is facilitated that is necessary for operation of electrical devices or home appliances installed on the finishing panel by passing an insulated wire through after perforating a top side portion of a mounting frame portion of a central portion of the runner, if needed.

Also, it is advantageous to install various electrical devices such as a TV, a computer, a flat panel display device, a humidifier, or an air purifier in an opening of the finishing panel, or install an electric outlet in necessary positions of the finishing panels for convenient use.

Although the present invention has been hereby described with reference to the exemplary embodiments as above, it should be understood that the present invention may be variously modified and changed within a scope without departing from the spirit and the area of the present invention, and thus that such modifications and changes are within the scope of the present invention.

| Reference Numerals | |
|---|---|
| 10: a runner | |
| 11: a base portion | 110: a washboard coupling groove |
| 12: a mounting frame portion | 125: a through hole |
| 20: a stud | |
| 21: a coupling groove | 2100: a stopping protrusion |
| 30: a finishing panel | |
| 31: an elastic coupling member | |
| 311: a contact portion | |
| 312: a protruding portion | |
| 312a: a separation groove 312a | 312b: a left side coupling piece |
| 312c: a right side coupling piece | 3120: a coupling projection |
| 313: a panel side finishing wing portion | |
| 32: an elastic piece | 35: an opening |
| 40: a washboard | |
| 410: a runner coupling piece | 420: a molding coupling groove |
| 50: a molding member | |
| 510: a washboard coupling portion | 520: a corner finishing portion |
| 60: a column assembly | |
| 61: a first column member | |
| 611: a first stopping protrusion | 615: a first coupling groove |
| 62: an edge column member | |
| 63: a second coupling groove | |
| 631: a second stopping protrusion | 635: a second coupling groove |
| 70: an end column member | |

-continued

| Reference Numerals | |
|---|---|
| 80: a gapper | |
| 81: a panel side compressing piece | 82: a center connecting portion |

INDUSTRIAL AVAILABILITY

The present invention relates to a prefabricated wall for interior and its construction method, and minimizes use of screws to facilitate an installation/disassembly and reassembly of a wall and allows a small number of personnel to perform the installation or disassembly work at once, and reduces labor costs, and can shorten a construction period, and is useful for a manufacturing field of a prefabricated wall.

What is claimed is:

1. A prefabricated wall for interior which partitions an indoor space of a building, the prefabricated wall comprising:

a runner installed to face a ceiling and a floor;

a plurality of studs vertically installed and fixed on both sides of the runner in a widthwise direction; and a finishing panel coupled to the plurality of studs, wherein each of the plurality of studs are provided with a pair of coupling grooves that is configured to extend in parallel to each other in a lengthwise direction, the finishing panel is provided with a pair of elastic coupling members which are fixedly coupled to both ends of left and right sides of an inner side surface of the finishing panel so as to extend in a vertical direction, and each of the pair of coupling grooves is provided on its left and right inner side surfaces with one or more stopping protrusion extending in a lengthwise direction, wherein each of the pair of elastic coupling members comprises a contact portion that adheres to the inner side surface of the finishing panel, and a protruding portion that is configured to protrude from the contact portion in an inward direction and extend in a lengthwise direction, wherein the protruding portion is provided on its central portion with a separation groove that forms concavely in a lengthwise direction such that a left side coupling piece and a right side coupling piece are formed on left and right sides of the separation groove, wherein one or more coupling projection is formed to extend in a lengthwise direction on a left side surface of a left coupling piece and a right side surface of a right coupling piece so as to be stuck with the one or more stopping protrusion, wherein each of the pair of elastic coupling members further comprises a panel side finishing wing portion that is bent from one end of the contact portion so as to encompass a side surface portion of the finishing panel and is configured to extend in a lengthwise direction, wherein the finishing panel is installed on a front surface portion of the plurality of studs by inserting and coupling the protruding portion of the elastic coupling members into the coupling grooves.

2. The prefabricated wall according to claim 1, wherein the prefabricated wall further comprises an elastic piece that is configured to extend in a lengthwise direction with a "U" shaped section in order to prevent a reduction in a restoring force of the left side coupling piece and the right side coupling piece by inserting into the separation groove, and wherein the elastic piece is coupled, so as to extend in a vertical direction, to both ends of left and right sides of the inner side surface of the finishing panel, with the pair of elastic coupling members in a state that the elastic piece is being inserted into the separation groove, thereby each of the pair of elastic coupling members is fixed to the finishing panel.

3. The prefabricated wall according to claim 1, further comprising a gapper that is configured to be compressed, wherein the gapper comprises a pair of panel side compressing pieces and a center connecting portion.

4. The prefabricated wall according to claim 1, further comprising a washboard occluding an area from the ceiling or the floor to a position that the finishing panel is installed, and a molding member covering between one end of the washboard and the ceiling or the floor, wherein the runner comprises a base portion that adheres to the ceiling or the floor, a mounting frame portion that is configured to protrude at a center part of one side of the base portion to extend in a lengthwise direction, and a washboard coupling groove that is configured to extend in a lengthwise direction at both ends in a widthwise direction of the base portion, wherein the washboard further comprises a runner coupling piece that is configured to be bent inward from an end of a direction adjacent to the ceiling or the floor to extend in a lengthwise direction, and a molding coupling groove that is configured to be bent inward at an end of a direction adjacent to the ceiling or the floor to extend in a lengthwise direction, wherein the molding member comprises a washboard coupling portion that is configured to extend in a lengthwise direction so as to be inserted into and coupled with the molding coupling groove, a corner finishing portion that is configured to be inclined such that one side of a widthwise direction thereof contacts with one end of the washboard and the other side thereof contacts the ceiling or the floor, wherein a rear surface of a lengthwise direction end of the plurality of studs is adhered to both side surfaces of a widthwise direction of the mounting frame portion to be combined and fixed thereto, respectively, wherein the washboard is installed in both sides of a widthwise direction of the runner by the runner coupling piece being inserted into and combined with the washboard coupling groove, and wherein the molding member is installed at the washboard by the washboard coupling portion being inserted into and combined with the molding coupling groove.

5. The prefabricated wall according to claim 1, further comprising a column assembly to allow a wall including the finishing panel combined with the plurality of studs to be adjacent to each other so as to form a corner, wherein the column assembly comprises a first column member that is combined to one side of the finishing panel at an inner side of the corner, an edge column member to form an outer edge of the corner, and a second column member that is provided with a second coupling groove which is configured to extend in a lengthwise direction for the elastic coupling member fixedly combined to the finishing panel to be inserted and combined in one side of a widthwise direction, and that is combined to one side of a widthwise direction of the edge column member in the other side, wherein the first column member comprises a first stopping protrusion that is configured to extend in a lengthwise direction so that one side of the finishing panel is stuck with both sides of an inner edge of the corner, and a first coupling groove that is configured to extend in a lengthwise direction in an outer side of the first stopping protrusion so that the elastic coupling member fixedly combined to the finishing panel is inserted and combined, wherein the second column member further comprises a second stopping protrusion that is configured to extend in a lengthwise direction in one side of the second coupling groove so that one side of the finishing panel is stuck, and wherein the edge column member and the second column member are combined in a way that a coupling piece provided at the other side of a widthwise direction of the second column member is inserted into a coupling groove provided at one side of a widthwise direction of the edge column member.

6. The prefabricated wall according to claim 1, further comprising a column assembly that allows a wall including the finishing panel combined with the plurality of studs to be crossed to each other, wherein the column assembly comprises at least one of; a first column member that is combined to one side of the finishing panel at an inner side of a corner of the wall; and a second column member that is provided with a second coupling groove that is configured to extend in a lengthwise direction for the elastic coupling member which is fixedly combined to the finishing panel to be inserted and combined in one side of a widthwise direction, wherein the first column member comprises a first stopping protrusion that is configured to extend in a lengthwise direction so that one side of the finishing panel is stuck with both sides of an inner edge of the corner, and a first coupling groove that is configured to extend in a lengthwise direction in an outer side of the first stopping protrusion so that the elastic coupling member which is fixedly combined to the finishing panel is inserted and combined, wherein the second column member further comprises a second stopping protrusion that is configured to extend in a lengthwise direction in one side of the second coupling groove so that one side of the finishing panel is stuck, and wherein in case of use of the second column member, a coupling piece provided at the other side of a widthwise direction of the second column member is inserted into and combined with a coupling groove provided at the other side of a widthwise direction of another second column member.

7. A construction method of a prefabricated wall for interior, the method comprising:

Step (a): Disposing and installing a runner to face a ceiling and a floor,

Step (b): Adhering a rear surface of a lengthwise direction end of each of a plurality of studs to a side surface of a widthwise direction of a mounting frame portion of the runner and then fixing it in a vertical direction, Step (c): Inserting a runner coupling piece of a washboard into a washboard coupling groove of the runner so that a washboard coupling portion of a molding member is inserted into a molding coupling groove of the washboard to allow the washboard that is combined to the molding member to be combined to both ends of a lengthwise direction of the runner, Step (d): Inserting a protruding portion of an elastic coupling member into a coupling groove of the studs so that a front surface portion of the plurality of studs is provided with a finishing panel, wherein the elastic coupling member is fixedly coupled to both ends of left and right sides of an inner side surface of the finishing panel so as to extend in a vertical direction, Step (e): Installing an electric outlet or home appliances in an opening of the finishing panel, and Step (f): Passing an insulated wire via a through hole formed on a top side portion of a mounting frame portion of a central portion of the runner into a space between rear surfaces of the stud fixed at both side surfaces of a widthwise direction of the mounting frame portion and into an internal space of the mounting frame portion so as to electrically connect to the home appliances or the electric outlet for a power supply, wherein the Step (d) further comprise step (d1) in which compressively installing a gapper in areas that are not finished by a panel side finishing wing of the elastic coupling member at an upper end portion and a lower end portion between the finishing panels, thereby filling to finish a gap between the finishing panels.

8. The construction method according to claim 7, further comprising a step (g) in which a side end portion of a wall including the finishing panel that is combined with the plurality of studs is coupled to one side of the column assembly so that the wall becomes adjacent to each other so as to form a corner or become crossed to each other.

9. The construction method according to claim 7, further comprising a step (g) in which a side end portion of a wall including the finishing panel that is combined with the plurality of studs is coupled to an end column member so as to finish the side end portion of the wall.

* * * * *